US011107387B2

(12) United States Patent
Shi et al.

(10) Patent No.: US 11,107,387 B2
(45) Date of Patent: Aug. 31, 2021

(54) DISPLAY COMPONENT, DISPLAY DEVICE AND DISPLAY CONTROL METHOD

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Lingyun Shi, Beijing (CN); Xue Dong, Beijing (CN); Dong Chen, Beijing (CN); Wei Sun, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 734 days.

(21) Appl. No.: 15/780,499

(22) PCT Filed: Nov. 2, 2017

(86) PCT No.: PCT/CN2017/109057
§ 371 (c)(1),
(2) Date: May 31, 2018

(87) PCT Pub. No.: WO2018/099235
PCT Pub. Date: Jun. 7, 2018

(65) Prior Publication Data

US 2021/0166605 A1 Jun. 3, 2021

(30) Foreign Application Priority Data

Nov. 29, 2016 (CN) ..... 201611073447.7

(51) Int. Cl.
*G09G 3/20* (2006.01)
*G09G 3/3225* (2016.01)
(Continued)

(52) U.S. Cl.
CPC ..... *G09G 3/2085* (2013.01); *G09G 3/3233* (2013.01); *G09G 2300/0842* (2013.01); *G09G 2340/16* (2013.01)

(58) Field of Classification Search
CPC ..... G09G 2300/0857; G09G 2340/16
See application file for complete search history.

(56) References Cited

U.S. PATENT DOCUMENTS 5,945,972 A * 8/1999 Okumura ..... G09G 3/3659 345/98
2002/0036616 A1 3/2002 Inoue
(Continued)

FOREIGN PATENT DOCUMENTS

CN 1381034 A 11/2002
CN 101059945 A 10/2007
(Continued)

OTHER PUBLICATIONS

International Search Report of PCT/CN2017/109057 in Chinese, dated Feb. 2, 2018 with English translation.
(Continued)

*Primary Examiner* — Patrick F Marinelli
(74) *Attorney, Agent, or Firm* — Collard & Roe, P.C.

(57) ABSTRACT

A display component, a display device and a display control method are provided. The display component includes a plurality of sub-pixel units arranged in a matrix; a plurality of storage units, arranged in one-to-one correspondence with the plurality of sub-pixel units, wherein, each sub-pixel unit is configured to display according to gray-scale data in a corresponding storage unit; and a control portion, in communication with the plurality of storage units, configured to execute at least one inter-transmission operation within one frame period.

18 Claims, 3 Drawing Sheets

(51) Int. Cl.
*G09G 3/3275* (2016.01)
*G09G 3/3233* (2016.01)

(56) References Cited

U.S. PATENT DOCUMENTS

| | | | | |
|---|---|---|---|---|
| 2003/0193514 | A1 | 10/2003 | Huang | |
| 2007/0241989 | A1 | 10/2007 | Kim | |
| 2008/0246709 | A1 | 10/2008 | Mori | |
| 2012/0038597 | A1* | 2/2012 | Coulson | G09G 3/3659 345/204 |
| 2013/0057568 | A1 | 3/2013 | Liao et al. | |
| 2018/0358415 | A1* | 12/2018 | Shi | G09G 3/3258 |
| 2019/0295464 | A1* | 9/2019 | Ishii | G09G 3/3225 |
| 2020/0294458 | A1* | 9/2020 | Iwasa | G02F 1/133 |

FOREIGN PATENT DOCUMENTS

| | | | |
|---|---|---|---|
| CN | 101281716 | A | 10/2008 |
| CN | 102314854 | A | 1/2012 |
| CN | 102385837 | A | 3/2012 |
| CN | 106448553 | A | 2/2017 |

OTHER PUBLICATIONS

Notice of Transmittal of the International Search Report of PCT/CN2017/109057 in Chinese, dated Feb. 2, 2018.
Written Opinion of the International Searching Authority of PCT/CN2017/109057 in Chinese, dated Feb. 2, 2018 with English translation.

* cited by examiner

DISPLAY COMPONENT, DISPLAY DEVICE AND DISPLAY CONTROL METHOD

CROSS REFERENCE TO RELATED APPLICATIONS

This application is the National Stage of PCT/CN2017/109057 filed on Nov. 2, 2017, which claims priority under 35 U.S.C. § 119 of Chinese Application No. 201611073447.7 filed on Nov. 29, 2016, the disclosure of which is incorporated by reference.

TECHNICAL FIELD

Embodiments of the present disclosure provide a display component, a display device and a display control method.

BACKGROUND

In a Virtual Reality (VR) system environment, many scenes switch display images based on a movement direction of an eyeball and a head, realizing operations such as translation, zooming in and zooming out of the images.

SUMMARY

An embodiment of the present disclosure provides a display component, including: a plurality of sub-pixel units arranged in a matrix; a plurality of storage units, arranged in one-to-one correspondence with the plurality of sub-pixel units, wherein, each sub-pixel unit is configured to display according to gray-scale data in the corresponding storage unit; and a control portion, in communication with the plurality of storage units, configured to execute at least one inter-transmission operation within one frame period, each inter-transmission operation including: selecting at least one of the sub-pixel units as a first inter-transmission unit; selecting at least another one of the sub-pixel units as a second inter-transmission unit; erasing gray-scale data stored by the storage unit corresponding to the at least one sub-pixel unit selected as the first inter-transmission unit; reading gray-scale data stored by the storage unit corresponding to the at least another one sub-pixel unit selected as the second inter-transmission unit as at least one first inter-transmission gray-scale data; and writing second inter-transmission gray-scale data into the storage unit corresponding to the at least one sub-pixel unit selected as the first inter-transmission unit, according to the at least one first inter-transmission gray-scale data.

In one example, the control portion is configured to control writing and/or erasing of the gray-scale data of the storage units corresponding to the sub-pixel units in a point-to-point manner.

In one example, the control portion is configured to analyze a frame image signal of the one frame period and a frame image signal of a previous frame period immediately adjacent to the one frame period, to execute the selecting at least one of the sub-pixel units as the first inter-transmission unit, and the selecting at least another one of the sub-pixel units as the second inter-transmission unit, and a sub-image displayed by the second inter-transmission unit within the previous frame period of the one frame period and a sub-image displayed by the first inter-transmission unit within the one frame period belong to a same portion of a same pattern.

In one example, a number of the at least another one sub-pixel unit selected as the second inter-transmission unit is equal to 1, a number of the at least one first inter-transmission gray-scale data is equal to 1, and the second inter-transmission gray-scale data is equal to the first inter-transmission gray-scale data.

In one example, a number of the at least one sub-pixel unit selected as the first inter-transmission unit is equal to 1, a number of the at least another one sub-pixel unit selected as the second inter-transmission unit is X, and a number of the at least one first inter-transmission gray-scale data is equal to X, where, X is a positive integer greater than 1; the second inter-transmission gray-scale data is equal to a sum of the X first inter-transmission gray-scale data divided by X, or the second inter-transmission gray-scale data is equal to any one of the first inter-transmission gray-scale data.

In one example, the control portion is further configured to execute writing and/or erasing operation of the gray-scale data on the storage unit corresponding to the sub-pixel unit not selected as the first inter-transmission unit by the at least one inter-transmission operation, within the one frame period.

In one example, the plurality of sub-pixel units are formed on a base substrate, and the base substrate is a monocrystalline silicon wafer.

In one example, each of the sub-pixel units further includes: a storage capacitor, a driving transistor and an organic light emitting diode element, a drain electrode of the driving transistor is connected with the organic light emitting diode element, and the storage capacitor is configured to maintain gate electrode voltage of the driving transistor.

In one example, each inter-transmission operation further includes: after the writing second inter-transmission gray-scale data into the storage unit corresponding to the at least one sub-pixel unit selected as the first inter-transmission unit, maintaining the second data not to be modified within remaining time of the one frame period.

Another embodiment of the present disclosure provides a display device, including the display component described above.

Yet an embodiment of the present disclosure provides a display control method of a display device, wherein, the display device includes a plurality of sub-pixel units arranged in a matrix; and a plurality of storage units, arranged in one-to-one correspondence with the plurality of sub-pixel units, and each sub-pixel unit is configured to display according to gray-scale data in the corresponding storage unit, the display control method comprises: executing at least one inter-transmission operation within one frame period, each inter-transmission operation including: selecting at least one of the sub-pixel units as a first inter-transmission unit; selecting at least another one of the sub-pixel units as second inter-transmission unit; erasing gray-scale data stored by the storage unit corresponding to the at least one sub-pixel unit selected as the first inter-transmission unit; reading gray-scale data stored by the storage unit corresponding to the at least another one sub-pixel unit selected as the second inter-transmission unit as at least one first inter-transmission gray-scale data; and writing second inter-transmission gray-scale data into the storage unit corresponding to the at least one sub-pixel unit selected as the first inter-transmission unit, according to the at least one first inter-transmission gray-scale data.

In one example, by analysis of a frame image signal of the one frame period and a frame image signal of a previous frame period immediately adjacent to the one frame period, the selecting at least one of the sub-pixel units as a first inter-transmission unit and the selecting at least another one of the sub-pixel units as a second inter-transmission unit are executed, and a sub-image displayed by the second inter-transmission unit within the previous frame period of the one frame period and a sub-image displayed by the first inter-transmission unit within the one frame period belong to a same portion of a same pattern.

In one example, a number of the at least another one sub-pixel unit selected as the second inter-transmission unit is equal to 1, a number of piece of the at least one first inter-transmission gray-scale data is equal to 1, and the first inter-transmission gray-scale data is equal to the second inter-transmission gray-scale data.

In one example, a number of the at least one sub-pixel unit selected as the first inter-transmission unit is equal to 1, a number of the at least another one sub-pixel unit selected as the second inter-transmission unit is X, and a number of the at least one first inter-transmission gray-scale data is equal to X, where, X is a positive integer greater than 1; the second inter-transmission gray-scale data is equal to a sum of the X first inter-transmission gray-scale data divided by X, or the second inter-transmission gray-scale data is equal to any one of the first inter-transmission gray-scale data.

In one example, the display control method further includes: executing the writing and/or erasing operation of the gray-scale data on the storage unit corresponding to the sub-pixel unit not selected as the first inter-transmission unit by the at least one inter-transmission operation, within the one frame period.

In one example, the plurality of sub-pixel units are formed on a base substrate, and the base substrate is a monocrystalline silicon wafer.

In one example, each of the sub-pixel units further includes: a storage capacitor, a driving transistor and an organic light emitting diode element, a drain electrode of the driving transistor is connected with the organic light emitting diode element, and the storage capacitor is configured to maintain gate electrode voltage of the driving transistor.

In one example, each inter-transmission operation further includes: after the writing second inter-transmission gray-scale data into the storage unit corresponding to the at least one sub-pixel unit selected as the first inter-transmission unit, maintaining the second data not to be modified within remaining time of the one frame period.

BRIEF DESCRIPTION OF THE DRAWINGS

In order to clearly illustrate the technical solution of the embodiments of the present disclosure, the drawings required in description of the embodiments or the related art will be briefly described in the following; it is obvious that the described drawings are only related to some embodiments of the present disclosure and thus are not limitative of the present disclosure.

DETAILED DESCRIPTION

Figure 1:
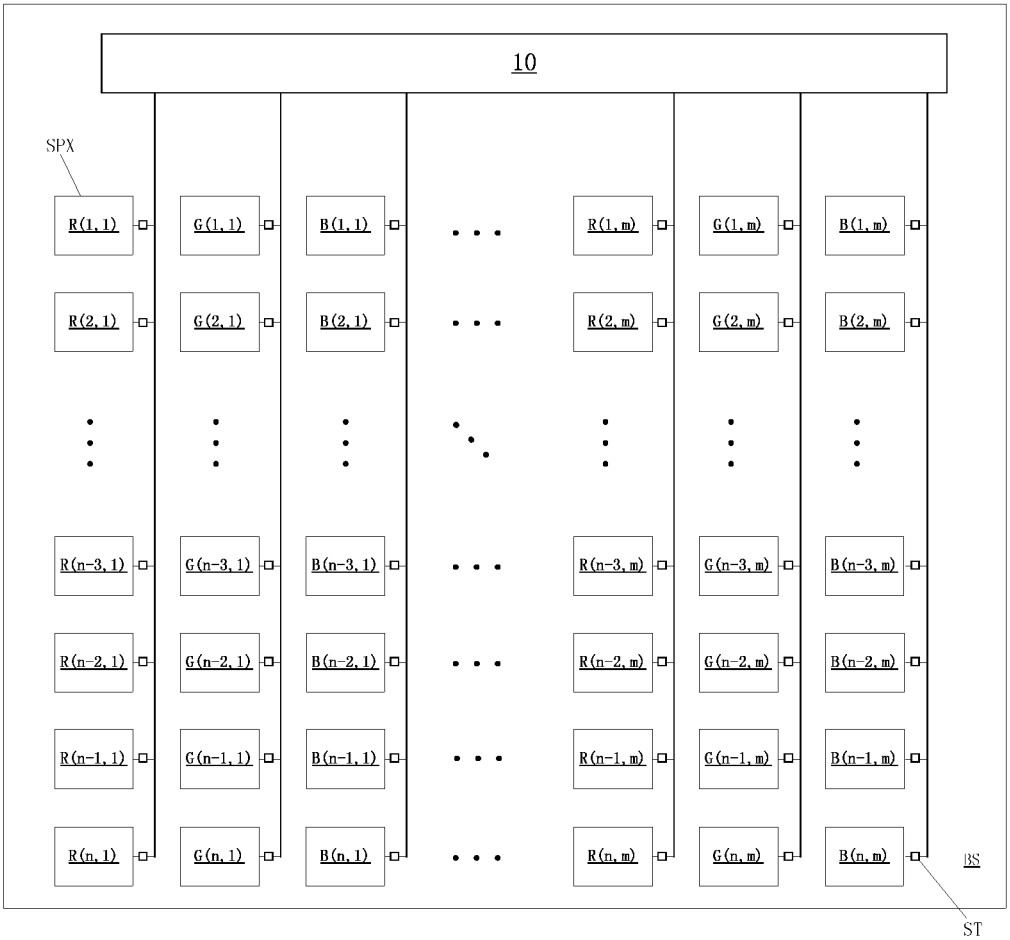
FIG. 1 is a schematic diagram illustrating a plurality of sub-pixel units, a plurality of storage units and a control portion of a display component provided by an embodiment of the present disclosure.

Hereinafter, the technical solutions of the embodiment of the present disclosure will be described in a clearly and fully understandable way with reference to the non-limitative exemplary embodiments described in detail below shown in the drawings, to more fully illustrate the exemplary embodiments of the present disclosure and their various features as well as advantageous details. It should be noted that the features illustrated in the drawings are not necessarily proportionally drawn. Descriptions of well-known materials, components, and process techniques are omitted, so as not to obscure the exemplary embodiments of the present disclosure. The examples are merely intended to facilitate understanding of implementation of the exemplary embodiments of the present disclosure and to further enable those skilled in the art to implement the exemplary embodiments. Thus, examples should not be construed as to limit the scope of the exemplary embodiments of the present disclosure.

Unless otherwise specified, the technical terms or scientific terms here should be of general meaning as understood by those ordinarily skilled in the art. In the present disclosure, words such as "first", "second" and the like do not denote any order, quantity, or importance, but rather are used for distinguishing different components. Words such as "up", "down", "left", "right" and the like are only used for expressing relative positional relationship, when the absolute position is described object is changed, the relative positional relationship may also be correspondingly changed.

In a virtual reality display system environment, a particularly large amount of data needs to be transmitted from an external data source to implement a high resolution and a high refresh rate so as to improve subjective perception of a person with respect to switching of display images. Such a data transmission amount has approached or exceeded a limit of existing transmission protocols.

Embodiments of the present disclosure provide a display device and a display control method, which are capable of implementing reduction of an external data transmission amount by data transmission between sub-pixels, so as to solve a problem of ultra-large-scale data transmission under high-resolution and high-refresh rate conditions.

FIG. 1 is a schematic diagram illustrating a plurality of sub-pixel units, a plurality of storage units and a control portion of a display component provided by an embodiment of the present disclosure.

Figure 2:
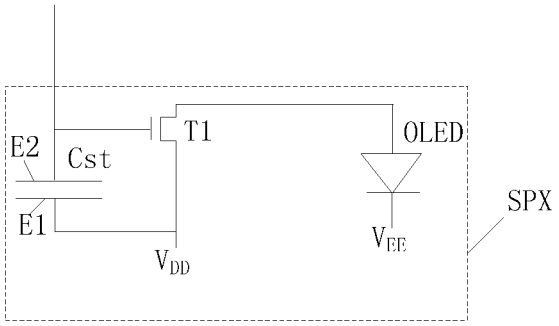
FIG. 2 illustrates a part of a pixel circuit of the sub-pixel unit of the display component provided by the embodiment of the present disclosure.

With reference to FIG. 1 and FIG. 2, the display component provided by the embodiment of the present disclosure is, for example, a display substrate, comprising a base substrate BS and a plurality of sub-pixel units SPX formed on the base substrate BS, a plurality of storage units ST and a control portion 10.

For example, the base substrate BS is a monocrystalline silicon wafer. It can be understood that the type of the base substrate is not limited in the embodiments of the present disclosure; for example, the base substrate BS can also be a glass substrate.

For example, the control portion 10 includes one or more CMOS integrated circuits. A formation position of the control portion 10 is not limited in the embodiment of the present disclosure, either; for example, in this embodiment, the control portion 10 can be completely formed on the base substrate BS. For example, the control portion 10 is an integrated IC, including a logic circuit located on the base substrate. The logic circuit is configured to convert digital information into a control signal so as to control ON/OFF of respective switches. In another example, the control portion 10 can have one portion formed on the base substrate BS and another portion formed outside the base substrate BS. In still another example, the control portion 10 may not be formed on the base substrate BS at all, for example, the control portion 10 is in communication with respective sub-pixel units SPX and/or a plurality of storage units ST in a wireless manner.

With reference to FIG. 1, the plurality of sub-pixel units SPX are arranged in a matrix. The plurality of sub-pixel units SPX include a plurality of red sub-pixel units R(1, 1) to R(n, m) arranged in a matrix, a plurality of green sub-pixel units G(1, 1) to G (n, m) arranged in a matrix, and a plurality of blue sub-pixel units B(1, 1) to B(n, m) arranged in a matrix. A red sub-pixel unit R(x, y), a green sub-pixel unit G(x, y), and a blue sub-pixel unit B(x, y) corresponding to one another constitute a pixel unit PX(x, y). For example, a red sub-pixel unit R(1, 1), a green sub-pixel unit G(1, 1), and a blue sub-pixel unit B(1, 1) constitute a pixel unit PX(1, 1). Here, the former label within the parentheses indicates a row number, and the latter label within the parentheses indicates a column number.

For example, with reference to FIG. 2, the sub-pixel unit SPX is an OLED display sub-pixel unit, including a storage capacitor Cst, a driving transistor T1 and an organic light emitting diode element OLED. The storage capacitor Cst is configured to maintain a gate electrode voltage of the driving transistor T1, so that the organic light emitting diode element OLED can continuously emit light. In this embodiment, a first electrode E1 of the storage capacitor Cst is electrically connected with a gate electrode of the driving transistor T1, and a second electrode E2 of the storage capacitor Cst is connected with a source electrode of the driving transistor T1. For example, storage capacitors of respective sub-pixel units connected with a same inter-transmission connection portion have a same capacitance. It can be understood that the pixel circuit shown in FIG. 2 is merely exemplary. In addition, a type of the sub-pixel unit SPX is not limited in the embodiment of the present disclosure; for example, the sub-pixel unit SPX may also be a liquid crystal sub-pixel unit.

With further reference to FIG. 1, in the display substrate provided by the embodiment of the present disclosure, the plurality of storage units ST are provided in one-to-one correspondence with the plurality of sub-pixel units, wherein, each sub-pixel unit is configured to display according to gray-scale data in a corresponding storage unit.

The control portion 10 is configured, for example, to provide an electrical signal (e.g., a digital signal) to corresponding storage units ST of respective sub-pixel units SPX, so as to execute writing and/or erasing operation(s) of the gray-scale data on respective storage units ST. The control portion 10 is in communication with the respective storage units ST. That is, the control portion 10 can be electrically connected with the respective storage units ST by wiring and other structures, and can also implement signal transmission with the respective storage units ST in a wireless communication manner. In this embodiment, the control portion 10 is configured to, for example, control writing and/or erasing of gray-scale data of the storage units corresponding to the plurality of sub-pixel units in a point-to-point manner. That is, a storage unit corresponding to each sub-pixel unit can independently execute the writing and/or erasing operation(s) of the gray-scale data, regardless of a case where the storage units corresponding to other sub-pixel units execute writing and/or erasing operations of gray-scale data.

The control portion 10 is configured to execute at least one inter-transmission operation within one frame period, the inter-transmission operation including: selecting at least one of the sub-pixel units as a first inter-transmission unit; selecting at least another one of the sub-pixel units as a second inter-transmission unit; erasing gray-scale data stored by a storage unit corresponding to the at least one sub-pixel unit selected as the first inter-transmission unit; reading gray-scale data stored by the storage unit corresponding to the at least another one sub-pixel unit selected as the second inter-transmission unit as first inter-transmission gray-scale data; and writing second inter-transmission gray-scale data into the storage unit corresponding to the at least one sub-pixel unit selected as the first inter-transmission unit, according to the first inter-transmission gray-scale data. Here, one frame period refers to, for example, time required for generating or displaying one frame of image.

For example, the control portion is configured to analyze a frame image signal of the one frame period and a frame image signal of a previous frame period immediately adjacent to the one frame period, to execute the selecting at least one of the sub-pixel units as the first inter-transmission unit and the selecting at least another one of the sub-pixel units as the second inter-transmission unit, wherein, a sub-image displayed by the second inter-transmission unit within the previous frame period of the one frame period and a sub-image displayed by the first inter-transmission unit within the one frame period belong to a same portion of a same pattern.

For example, the first frame period is the previous frame period immediately adjacent to the second frame period. By analyzing a first frame image signal of the first frame period and a second frame image signal of the second frame period, it can be known that a second sub-image to be displayed within the second frame period by the plurality of sub-pixel units in a first position and a first sub-image to be displayed within the first frame period by the plurality of sub-pixel units in a second position are of a same or similar patterns, for example, a same or similar triangular patterns. Here, the first position is different from the second position; the similar patterns refer to that one pattern is a pattern obtained by zooming in or zooming out the other pattern in equal proportion. Then, sub-pixel units at a position where a same portion of the same or similar patterns are to be displayed within the first frame period and the second frame period can be respectively selected as the second inter-transmission unit and the first inter-transmission unit. For example, a sub-pixel unit at an upper vertex of a triangle to be displayed in the second frame period can be selected as the first inter-transmission unit, and a sub-pixel unit at the same upper vertex of the triangle to be displayed in the first frame period can be selected as the second inter-transmission unit. In addition, at least one of information on the number of sub-pixel units located between the first inter-transmission unit and the second inter-transmission unit in a row direction and in a column direction, information on proportion for zooming in or zooming out the similar patterns, and information on the number of sub-pixel units of the same or similar patterns occupying in the row direction and in the column direction can also be obtained by the above-described analysis. In this way, in a case where the position information of the second inter-transmission unit is known, positioning of the first inter-transmission unit can be executed in combination with the at least one of the information described above. The control portion is further configured to execute the writing and/or erasing operations of the gray-scale data on a storage unit corresponding to the sub-pixel unit not selected as the first inter-transmission unit by the at least one inter-transmission operation within the one frame period.

Although one pixel unit according to the above-described embodiment includes three sub-pixel units, it can be understood that the number of sub-pixel units included in one pixel unit is not limited in the embodiment of the present disclosure. For example, one pixel unit of the display substrate provided by the embodiment of the present disclosure may include one or four sub-pixel units. In a case where one pixel unit includes only one sub-pixel unit, the sub-pixel unit itself can be considered as representing the pixel unit.

An embodiment of the present disclosure provides a display device, comprising the display component provided by any one of the above-described embodiments. For example, the display device can be a silicon-based micro-display device.

Still another embodiment of the present disclosure provides a display control method of a display device, and the display device comprises, for example, the display component provided by any one of the above-described embodiments.

Figure 3:
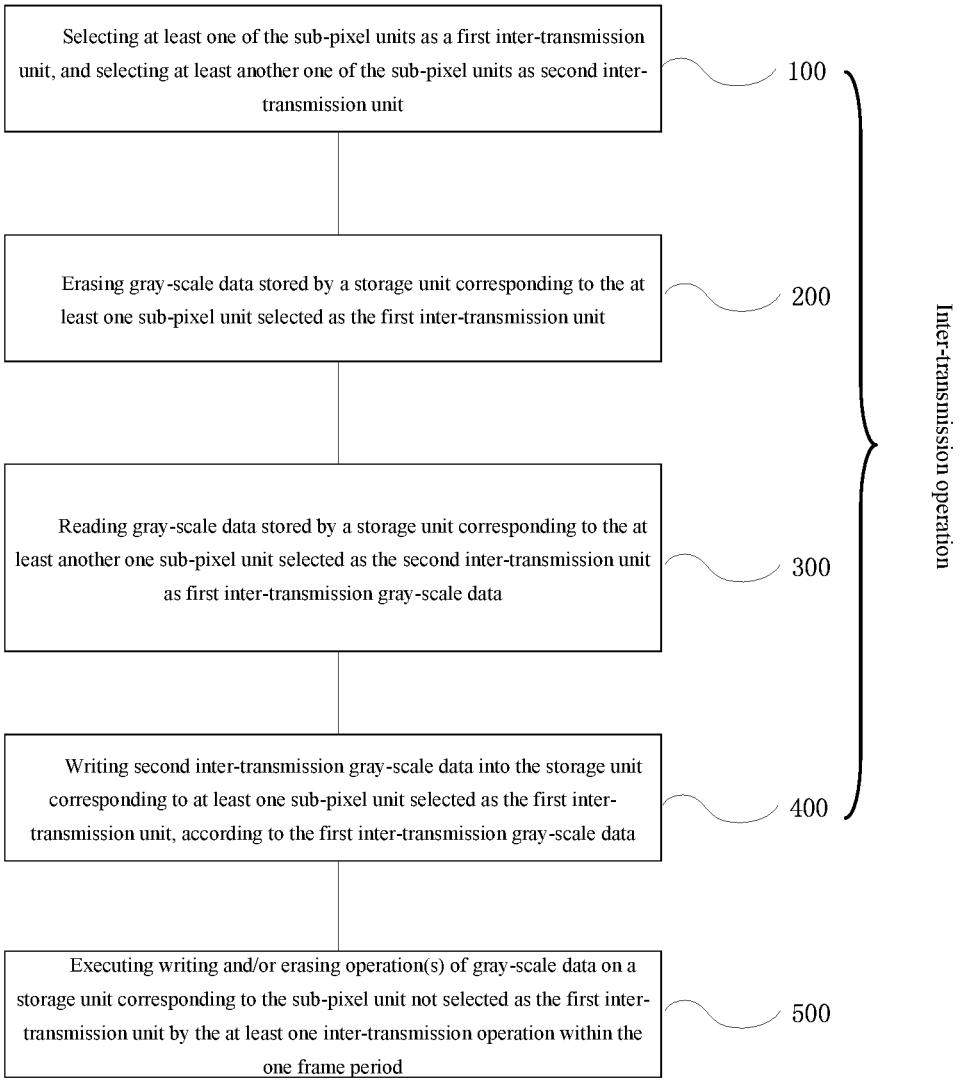
FIG. 3 is a flow chart illustrating a display control method of a display device provided by an embodiment of the present disclosure.

With reference to FIG. 3, the display control method comprises: executing at least one inter-transmission operation within one frame period, the inter-transmission operation including:

Step 100: selecting at least one of the sub-pixel units as a first inter-transmission unit, and selecting at least another one of the sub-pixel units as second inter-transmission unit;

Step 200: erasing gray-scale data stored by the storage unit corresponding to the at least one sub-pixel unit selected as the first inter-transmission unit;

Step 300: reading gray-scale data stored by the storage unit corresponding to the at least another one sub-pixel unit selected as the second inter-transmission unit as first inter-transmission gray-scale data; and Step 400: writing second inter-transmission gray-scale data into the storage unit corresponding to at least one sub-pixel unit selected as the first inter-transmission unit, according to the first inter-transmission gray-scale data.

By analysis of a frame image signal of the one frame period and a frame image signal of a previous frame period immediately adjacent to the one frame period, the selecting at least one of the sub-pixel units as a first inter-transmission unit and the selecting at least another one of the sub-pixel units as a second inter-transmission unit are executed, wherein, a sub-image displayed by the second inter-transmission unit within the previous frame period of the one frame period and a sub-image displayed by the first inter-transmission unit within the one frame period belong to a same portion of a same pattern.

For example, the first frame period is the previous frame period immediately adjacent to the second frame period. By analyzing a first frame image signal of the first frame period and a second frame image signal of the second frame period, it can be known that a second sub-image to be displayed in the second frame period by a plurality of sub-pixel units in a first position and a first sub-image to be displayed in the first frame period by a plurality of sub-pixel units in a second position are of a same or similar patterns, for example, a same or similar triangular patterns. Here, the first position is different from the second position; the similar patterns refer to that one pattern is a pattern obtained by zooming in or zooming out the other pattern in equal proportion. Then, sub-pixel units at positions where a same portion of the same or similar patterns are to be displayed within the first frame period and the second frame period can be respectively selected as the second inter-transmission unit and the first inter-transmission unit. For example, a sub-pixel unit at an upper vertex of a triangle to be displayed in the second frame period can be selected as the first inter-transmission unit, and a sub-pixel unit at the same upper vertex of the triangle to be displayed in the first frame period can be selected as the second inter-transmission unit. In addition, at least one of information on the number of sub-pixel units that located between the first inter-transmission unit and the second inter-transmission unit in a row direction and in a column direction, information on proportion for zooming in or zooming out the similar pattern, and information on the number of sub-pixel units of the same or similar pattern occupying in the row direction and in the column direction may also be obtained by the above-described analysis. In this way, in a case where the position information of the second inter-transmission unit is known, positioning of the first inter-transmission unit can be executed in combination with the at least one piece of information described above. For example, in the embodiment shown in FIG. 3, the display control method comprises executing one inter-transmission operation within one frame period.

For example, in a first case, a sub-image at a position of a sub-pixel unit R(1, 1) in the first frame period needs to be translated to a position of a sub-pixel unit R(n-1, m) in the second frame period, so as to display. Here, the first frame period and the second frame period represent two immediately adjacent two frame periods; that is, the time point when the first frame period ends is the time point when the second frame period starts. The display control method can include executing inter-transmission operations below within the second frame period:

Selecting the sub-pixel unit R(n-1, m) as the first inter-transmission unit, and selecting the sub-pixel unit R(1, 1) as the second inter-transmission unit;

Erasing gray-scale data stored in the storage unit corresponding to the sub-pixel unit R(n-1, m) selected as the first inter-transmission unit;

Reading gray-scale data stored in the storage unit corresponding to the sub-pixel unit R(1, 1) selected as the second inter-transmission unit as the first inter-transmission gray-scale data, for example, 100; and Writing second inter-transmission gray-scale data into the storage unit corresponding to the sub-pixel unit R(n-1, m) selected as the first inter-transmission unit, the second inter-transmission gray-scale data being equal to the first inter-transmission gray-scale data.

In this way, by signal inter-transmission between sub-pixels, the sub-image at the position of the sub-pixel unit R(1, 1) in the first frame period is translated to the position of the sub-pixel unit R(n-1, m) in the second frame period, so as to display. Thus, the data signal originally supposed to be written into the sub-pixel unit R(n-1, m) in the second frame period can be removed, so as to reduce an external data transmission amount, which solves the problem of ultra-large-scale data transmission under high-resolution and high-refresh rate conditions. Here, the external data refers to, for example, data from outside the sub-pixels.

For example, in a second case, the sub-image at the position of the sub-pixel unit R(1, 1) in the first frame period needs to be zoomed in to the position of the sub-pixel units R(n-1, m) and R (n, m) in the second frame period, so as to display. The display control method can include executing inter-transmission operations below within the second frame period:

Selecting the sub-pixel units R(n-1, m) and R(n, m) as first inter-transmission units, and selecting the sub-pixel unit R(1, 1) as the second inter-transmission unit;

Erasing gray-scale data stored in storage units corresponding to the sub-pixel units R(n-1, m) and R(n, m) selected as the first inter-transmission units;

Reading the gray-scale data stored in the storage unit corresponding to the sub-pixel unit R(1, 1) selected as the second inter-transmission unit as the first inter-transmission gray-scale data, for example, 100; and Writing the second inter-transmission gray-scale data into the storage units corresponding to the sub-pixel units R(n-1, m) and R(n, m) selected as the first inter-transmission units, the second inter-transmission gray-scale data being equal to the first inter-transmission gray-scale data.

In this way, by signal inter-transmission between sub-pixels, the sub-image at the position of the sub-pixel unit R(1, 1) in the first frame period is zoomed in to the position of the sub-pixel units R(n-1, m) and R(n, m) in the second frame period, so as to display. Thus, the data signal originally supposed to be written into the sub-pixel units R(n-1, m) and R(n, m) in the second frame period can be removed, so as to reduce an external data transmission amount, which solves the problem of ultra-large-scale data transmission under high-resolution and high-refresh rate conditions.

For example, in a third case, the sub-image at the position of sub-pixel units R(1, 1) and R(2, 1) in the first frame period needs to be zoomed out to the position of the sub-pixel unit R (n, m) in the second frame period, so as to display. The display control method can include executing inter-transmission operations below within the second frame period:

Selecting the sub-pixel unit R(n, m) as the first inter-transmission unit, and selecting the sub-pixel units R(1, 1) and R(2, 1) as second inter-transmission units;

Erasing the gray-scale data stored in the storage unit corresponding to the sub-pixel unit R(n, m) selected as the first inter-transmission unit;

Reading gray-scale data stored in the storage units corresponding to the sub-pixel units R(1, 1) and R(2, 1) selected as the second inter-transmission units as the first inter-transmission gray-scale data, for example, respectively 100 and 200; and Writing the second inter-transmission gray-scale data into the storage unit corresponding to the sub-pixel unit R(n, m) selected as the first inter-transmission unit. The second inter-transmission gray-scale data is equal to the first inter-transmission gray-scale data divided by 2, that is, 150; or the second inter-transmission gray-scale data is equal to any one of the first inter-transmission gray-scale data, i.e., 100 or 200.

In this way, by signal inter-transmission between sub-pixels, the sub-image at the position of the sub-pixel units R(1, 1) and R(2, 1) in the first frame period is zoomed out to the position of the sub-pixel unit R(n, m) in the second frame period, so as to display. Thus, the data signal originally supposed to be written into the sub-pixel unit R(n, m) in the second frame period can be removed, so as to reduce an external data transmission amount, which solves the problem of ultra-large-scale data transmission under high-resolution and high-refresh rate conditions.

In the embodiment of the present disclosure, for example, the first inter-transmission gray-scale data are in one-to-one correspondence with the gray-scale data stored in the storage unit corresponding to the sub-pixel units selected as the second inter-transmission units.

Each of the inter-transmission operations further includes, for example, after the writing second inter-transmission gray-scale data into the storage unit corresponding to the at least one sub-pixel unit selected as the first inter-transmission unit, maintaining the second data within the remaining time of the one frame period (for example, the second frame period in the above-described embodiment) not to be modified.

It can be understood that, in the embodiments of the present disclosure, the number of sub-pixel units selected as the first inter-transmission units is not limited, and the number of sub-pixel units selected as the second inter-transmission units is not limited.

Although in the above-described embodiment, the display control method is described by taking a plurality of red sub-pixels as example, it can be understood that, within a same frame period, data inter-transmission between a plurality of green sub-pixels can also be implemented by the above-described inter-transmission operations, and data inter-transmission between a plurality of blue sub-pixels can also be implemented by the above-described inter-transmission operations.

In the above-described embodiments of the present disclosure relating to color display, for example, the at least one sub-pixel unit as the first inter-transmission unit and the at least another one sub-pixel unit as the second inter-transmission unit selected by a same inter-transmission operation are configured to have a same color. However, the present disclosure is not limited thereto. For example, in a case where the display control method provided by the embodiment of the present disclosure is applied to a black and white display device (i.e., an achromatic display device), it is not necessary to consider colors of the at least one sub-pixel unit selected as the first inter-transmission unit and the at least another one sub-pixel unit selected as the second inter-transmission unit by a same inter-transmission operation.

The display control method provided by the embodiment of the present disclosure, for example, after the step 400, further includes:

Step 500: executing writing and/or erasing operation(s) of gray-scale data on a storage unit corresponding to the sub-pixel unit not selected as the first inter-transmission unit by the at least one inter-transmission operation within the one frame period.

For example, in the above-described embodiment, writing and/or erasing of the gray-scale data of the storage capacitor of the sub-pixel unit not selected as the first inter-transmission unit by the at least one inter-transmission operation is executed within the second frame period.

For example, the sub-pixel unit(s) selected as the first inter-transmission unit(s) is/are, for example, a portion of the sub-pixel unit array. With respect to a sub-pixel unit other than the sub-pixel unit(s) selected as the first inter-transmission unit(s) (including the sub-pixel unit selected as the second inter-transmission unit), digital gray-scale data can be provided to the storage units corresponding to the respective sub-pixel units by the control portion 10 in a point-to-point manner, to execute displaying, so as to display a complete frame of image within the second frame period.

It can be understood that, in the embodiment of the present disclosure, the inter-transmission operation is not necessarily executed in every frame period. In addition, in a frame period in which the inter-transmission operation is executed, not every pixel is related to the inter-transmission operation. For example, one second includes 60 frame periods, that is, the first frame period to the 60th frame period. Each period is 1/60 seconds. In these 60 frame periods, for example, only two inter-transmission operations are executed in the second frame period. For example, the two inter-transmission operations are executed in order to implement translating the sub-image at the position of the sub-pixel units R(1, 1) and R(2, 1) in the first frame period to the position of the sub-pixel units R(n-1, m) and R(n, m) in the second frame period, so as to display. In this case, in the second frame period, sub-pixel units except the sub-pixel units R(n-1, m) and R(n, m) can be performed by operations such as writing external data, erasing original data or maintaining unchanged further executed. Thus, all the sub-pixels collectively display a frame of a complete image within the third frame period. With respect to frame periods except the second frame period, it is not limited whether or not the inter-transmission operation is executed therein.

In addition, in the display control method provided by the embodiment of the present disclosure, unless otherwise explicitly limited, a sequence of the respective steps/sub-steps can be changed.

The embodiments of the present disclosure provide the display component and/or the display device, comprising: the base substrate; the plurality of sub-pixel units arranged in a matrix, formed on the base substrate; the plurality of storage units, arranged in one-to-one correspondence with the plurality of sub-pixel units, wherein, each sub-pixel unit is configured to display according to the gray-scale data in the corresponding storage unit; and the control portion, configured to include: one or more processors; one or more memories; and computer program instructions stored in the memory, which execute the respective steps and/or sub-steps of the display control method provided by the above-described embodiments when the computer program instructions are executed by the processor.

Although the present disclosure has been described thoroughly above by using general description and specific embodiments, some modifications or improvements can be made on the basis of the embodiments of the present disclosure, which will be obvious to those skilled in the art. Therefore, these modifications or improvements made without departing from the spirit of the present disclosure all fall within the protection scope of the present disclosure.

The foregoing embodiments merely are exemplary embodiments of the present disclosure, and not intended to define the scope of the present disclosure, and the scope of the present disclosure is determined by the appended claims.

The present application claims priority of Chinese Patent Application No. 201611073447.7 filed on Nov. 29, 2016, the disclosure of which is incorporated herein by reference in its entirety as part of the present application.

The invention claimed is:

1. A display component, comprising:

a plurality of sub-pixel units arranged in a matrix;

a plurality of storage units, arranged in one-to-one correspondence with the plurality of sub-pixel units, wherein, each of the plurality of sub-pixel units is configured to display according to gray-scale data in a corresponding storage unit; and a control portion, in communication with the plurality of storage units, configured to execute at least one inter-transmission operation, each inter-transmission operation including:

selecting at least one of the sub-pixel units as a first inter-transmission unit;

selecting at least another one of the sub-pixel units as a second inter-transmission unit;

erasing gray-scale data stored by the storage unit corresponding to the at least one sub-pixel unit selected as the first inter-transmission unit;

reading gray-scale data stored by the storage unit corresponding to the at least another one sub-pixel unit selected as the second inter-transmission unit as at least one first inter-transmission gray-scale data; and writing second inter-transmission gray-scale data into the storage unit corresponding to the at least one sub-pixel unit selected as the first inter-transmission unit, according to the at least one first inter-transmission gray-scale data.

2. The display component according to claim 1, wherein, the control portion is configured to control writing and/or erasing of the gray-scale data of the storage units corresponding to the sub-pixel units in a point-to-point manner.

3. The display component according to claim 1, wherein, the control portion is configured to analyze a frame image signal of the one frame period and a frame image signal of a previous frame period immediately adjacent to the one frame period, to execute the selecting at least one of the sub-pixel units as the first inter-transmission unit, and the selecting at least another one of the sub-pixel units as the second inter-transmission unit, and a sub-image displayed by the second inter-transmission unit within the previous frame period of the one frame period and a sub-image displayed by the first inter-transmission unit within the one frame period belong to a same portion of a same pattern.

4. The display component according to claim 1, wherein, a number of the at least another one sub-pixel unit selected as the second inter-transmission unit is equal to 1, a number of the at least one first inter-transmission gray-scale data is equal to 1, and the second inter-transmission gray-scale data is equal to the first inter-transmission gray-scale data.

5. The display component according to claim 1, wherein, a number of the at least one sub-pixel unit selected as the first inter-transmission unit is equal to 1, a number of the at least another one sub-pixel unit selected as the second inter-transmission unit is X, and a number of the at least one first inter-transmission gray-scale data is equal to X, where, X is a positive integer greater than 1; the second inter-transmission gray-scale data is equal to a sum of the X first inter-transmission gray-scale data divided by X, or the second inter-transmission gray-scale data is equal to any one of the first inter-transmission gray-scale data.

6. The display component according to claim 1, wherein, the control portion is further configured to execute writing and/or erasing operation of the gray-scale data on the storage unit corresponding to the sub-pixel unit not selected as the first inter-transmission unit by the at least one inter-transmission operation, within the one frame period.

7. The display component according to claim 1, wherein, the plurality of sub-pixel units are formed on a base substrate, and the base substrate is a monocrystalline silicon wafer.

8. The display component according to claim 1, wherein, each of the sub-pixel units further includes: a storage capacitor, a driving transistor and an organic light emitting diode element, a drain electrode of the driving transistor is connected with the organic light emitting diode element, and the storage capacitor is configured to maintain gate electrode voltage of the driving transistor.

9. The display component according to claim 1, wherein, each inter-transmission operation further includes: after the writing second inter-transmission gray-scale data into the storage unit corresponding to the at least one sub-pixel unit selected as the first inter-transmission unit, maintaining the second data not to be modified within remaining time of the one frame period.

10. A display device, comprising the display component according to claim 1.

11. A display control method of a display device, wherein, the display device comprises a plurality of sub-pixel units arranged in a matrix; and a plurality of storage units, arranged in one-to-one correspondence with the plurality of sub-pixel units, and each sub-pixel unit is configured to display according to gray-scale data in a corresponding storage unit, the display control method comprises: executing at least one inter-transmission operation within one frame period, each inter-transmission operation including:

selecting at least one of the sub-pixel units as a first inter-transmission unit;

selecting at least another one of the sub-pixel units as second inter-transmission unit;

erasing gray-scale data stored by the storage unit corresponding to the at least one sub-pixel unit selected as the first inter-transmission unit;

reading gray-scale data stored by the storage unit corresponding to the at least another one sub-pixel unit selected as the second inter-transmission unit as at least one first inter-transmission gray-scale data; and writing second inter-transmission gray-scale data into the storage unit corresponding to the at least one sub-pixel unit selected as the first inter-transmission unit, according to the at least one first inter-transmission gray-scale data.

12. The display control method according to claim 11, wherein, by analysis of a frame image signal of the one frame period and a frame image signal of a previous frame period immediately adjacent to the one frame period, the selecting at least one of the sub-pixel units as a first inter-transmission unit and the selecting at least another one of the sub-pixel units as a second inter-transmission unit are executed, and a sub-image displayed by the second inter-transmission unit within the previous frame period of the one frame period and a sub-image displayed by the first inter-transmission unit within the one frame period belong to a same portion of a same pattern.

13. The display control method according to claim 11, wherein, a number of the at least another one sub-pixel unit selected as the second inter-transmission unit is equal to 1, a number of piece of the at least one first inter-transmission gray-scale data is equal to 1, and the first inter-transmission gray-scale data is equal to the second inter-transmission gray-scale data.

14. The display control method according to claim 11, wherein, a number of the at least one sub-pixel unit selected as the first inter-transmission unit is equal to 1, a number of the at least another one sub-pixel unit selected as the second inter-transmission unit is X, and a number of the at least one first inter-transmission gray-scale data is equal to X, where, X is a positive integer greater than 1; the second inter-transmission gray-scale data is equal to a sum of the X first inter-transmission gray-scale data divided by X, or the second inter-transmission gray-scale data is equal to any one of the first inter-transmission gray-scale data.

15. The display control method according to claim 11, further comprising: executing the writing and/or erasing operation of the gray-scale data on the storage unit corresponding to the sub-pixel unit not selected as the first inter-transmission unit by the at least one inter-transmission operation, within the one frame period.

16. The display control method according to claim 11, wherein, the plurality of sub-pixel units are formed on a base substrate, and the base substrate is a monocrystalline silicon wafer.

17. The display control method according to claim 11, wherein, each of the sub-pixel units further includes: a storage capacitor, a driving transistor and an organic light emitting diode element, a drain electrode of the driving transistor is connected with the organic light emitting diode element, and the storage capacitor is configured to maintain gate electrode voltage of the driving transistor.

18. The display control method according to claim 11, wherein, each inter-transmission operation further includes: after the writing second inter-transmission gray-scale data into the storage unit corresponding to the at least one sub-pixel unit selected as the first inter-transmission unit, maintaining the second data not to be modified within remaining time of the one frame period.

* * * * *